US008180236B2

(12) United States Patent
Hanashi

(10) Patent No.: US 8,180,236 B2
(45) Date of Patent: May 15, 2012

(54) IMAGE FORMING APPARATUS

(75) Inventor: Ryo Hanashi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 125 days.

(21) Appl. No.: 12/721,720

(22) Filed: Mar. 11, 2010

(65) Prior Publication Data

US 2010/0239286 A1 Sep. 23, 2010

(30) Foreign Application Priority Data

Mar. 17, 2009 (JP) ..... 2009-065267

(51) Int. Cl.
*G03G 15/02* (2006.01)

(52) U.S. Cl. ..... 399/50; 399/168

(58) Field of Classification Search ..... 399/50, 399/168

See application file for complete search history.

(56) References Cited

U.S. PATENT DOCUMENTS

| | | | |
|---|---|---|---|
| 6,532,347 | B2 | 3/2003 | Watanabe et al. |
| 6,640,063 | B2 | 10/2003 | Adachi et al. |
| 2001/0019669 | A1 | 9/2001 | Watanabe et al. |
| 2002/0102108 | A1 | 8/2002 | Adachi et al. |

FOREIGN PATENT DOCUMENTS

| | | | |
|---|---|---|---|
| JP | 2001-201921 | A | 7/2001 |
| JP | 2002-182455 | A | 6/2002 |

*Primary Examiner* — David Gray
*Assistant Examiner* — Erika J Villaluna
(74) *Attorney, Agent, or Firm* — Fitzpatrick, Cella, Harper & Scinto

(57) ABSTRACT

An image forming apparatus includes a drum; a charging member; a charging bias applying device; an image forming device; a detecting device for detecting a current passing between the charging member and the drum; an executing device for selectively executing a first mode in which the charging bias of a first frequency is applied to form the image on the drum rotated at a first speed and a second mode in which the charging bias of a second frequency is applied to form the image on the drum rotated at a second speed; a calculating device for calculating information indicating a relationship between an output of the detecting device when the AC voltage of the first frequency is applied and an output of the detecting device when the AC voltage of the second frequency is applied; and an adjusting device for adjusting a peak-to-peak voltage to be applied to the charging member in the first mode based on the output of the detecting device obtained by applying the AC voltage of the first frequency to the charging member and for adjusting a peak-to-peak voltage to be applied to the charging member in the second mode based on the output of the detecting device obtained by applying the AC voltage of the first frequency to the charging member and the information calculated by the calculating device.

5 Claims, 11 Drawing Sheets

IMAGE FORMING APPARATUS

FIELD OF THE INVENTION AND RELATED ART

The present invention relates to an image forming apparatus for effecting discharge current amount control.

In recent years, compared with a corona charging method, from the viewpoints of a low voltage process, a low ozone generation amount, and a low cost, a contact charging method in which a charging member of a roller type, a blade type, or the like is brought into contact with a surface of the image bearing member and then a voltage is applied to the charging member to electrically charge the surface of the image bearing member is going mainstream. Particularly, the roller-type charging member is capable of effecting stable charging for a long term.

The voltage applied to the charging member may be only a DC voltage but uniform charging can be realized by applying an oscillating voltage to alternately causing discharge on a positive side and on a negative side.

For example, the oscillating voltage in the form of the DC voltage (DC offset bias) biased with an AC voltage having a peak-to-peak voltage which is not less than two times a discharge start threshold voltage (discharge start voltage or charging start voltage) of a member to be charged when the DC voltage is applied. As a result, the charging of the member to be charged is uniformized to result in uniform charging.

A waveform of the oscillating voltage is not limited to a sinusoidal wave but may also be a rectangular wave, a triangular wave, or a pulse wave. Further, the oscillating voltage may include a voltage of the rectangular wave formed by periodically turning the DC voltage on and off and a voltage providing the same output as that of a superposed voltage of the AC voltage and the DC voltage by periodically changing a value of the DC voltage.

The contact charging method in which the oscillating voltage is applied to the charging member to charge the image bearing member is referred to as an "AC charging method". Further, the contact charging method in which only the DC voltage is applied to the charging member to charge the image bearing member is referred to as a "DC charging method".

In the AC charging method, compared with the DC charging method, an amount of electric discharge with respect to the image bearing member is increased, so that a deterioration of the image bearing member such as abrasion (wearing) of the image bearing member is accelerated and also an abnormal image such as image flow by an electric discharge product in a high temperature and high humidity environment is caused to occur in some cases. In view of these problems, it is desirable that the electric discharge occurring alternately on the positive side and on the negative side is minimized by applying a required minimum voltage to the charging member.

However, actually, a relationship between the voltage applied to the charging member and the electric discharge amount is not always constant but varies depending on thicknesses of a photosensitive layer and a dielectric layer of the image bearing member and a fluctuation in environment of the charging member and the ambient air. In a low temperature/low humidity (L/L) environment, the material is dried to increase its electric resistance value, so that the electric discharge is less liable to occur. For this reason, in order to realize the uniform charging in the L/L environment, there is need to apply a peak-to-peak voltage having a certain value or more. On the other hand, even in the case where a minimum voltage value at which uniform chargeability is obtained in the L/L environment, in a high temperature/high humidity (H/H) environment, the material rather takes up moisture to lower its electric resistance value, so that the charging member causes the electric discharge more than necessary. As a result, the discharge amount is increased to cause problems such as occurrences of the image flow, image blur, and fusion of toner and abrasion and short lifetime of the image bearing member due to a surface deterioration of the image bearing member, and the like.

In order to suppress the increase and decrease of the discharge amount by the environmental fluctuation, other than a "constant AC voltage control method" in which a constant AC voltage is always applied, there is a "constant AC current control method" in which a value of an AC current passing through the charging member under application of the AC voltage to the charging member is controlled. According to this constant AC current control method, a value of a peak-to-peak voltage of the AC voltage can be increased in the L/L environment in which the electric resistance of the material is increased and can be decreased in the H/H environment the electric resistance of the material is lowered. For that reason, compared with the constant AC voltage control method, a degree of the increase and decrease of the discharge amount can be suppressed.

Here, the charging member is not necessarily required to contact the surface of the image bearing member. The charging member may also be disposed in non-contact with and close to the image bearing member with a gap (spacing) of, e.g., about several tens of microns so long as an electrically dischargeable area determined by a gap voltage and Paschen's curve is ensured between the charging member and the image bearing member with reliability (proximity charging method). The present invention is also applicable to the image forming apparatus employing the proximity charging method but the contact charging method will be described below as an example.

When a further increase in lifetime of the image bearing member is intended, even the constant AC current control does not completely suppress the increase and decrease of the discharge amount due to the fluctuation in electric resistance value due to manufacturing variation or contamination of the charging member, the fluctuation in electrostatic capacity of the image bearing member due to continuous image formation, and a variation of a high voltage device of a main assembly of the image forming apparatus. In order to suppress the increase and decrease of the discharge amount, it is desired that the manufacturing variation and an environmental change are suppressed and that the variation of the high voltage device is eliminated but these factors can cause the increase in cost.

In order to solve this problem, as described in Japanese Laid-Open Patent Application (JP-A) 2001-201921, a discharge current control method is proposed. That is, when an electric discharge start voltage with respect to the image bearing member at the time of applying the DC voltage to the charging member is Vth, a relationship between the AC voltage and the AC current in an area of not less than two times Vth (discharged area) and an area of less than two times Vth (undischarged area) is obtained. Further, from a difference in function obtained by this relationship, a discharge current amount is obtained and is controlled at a constant value. According to the discharge current control method, irrespective of the variation of the electric resistance value of the charging member due to the variations of the environment and the manufacturing, excessive electric discharge is not caused to occur, so that it is possible to always cause the electric discharge in a constant amount. Accordingly, uniform charging can be ensured without causing the problems of the deterioration of the image bearing member, the toner fusion, the image flow, and the like.

Incidentally, in recent years, the image forming apparatus such as a printer is desired to permit printing on various types of media such as thick paper and an OHP sheet with diversification of user's print needs. Further, the image forming apparatus is also required to be adapted to high resolution (high pixel density). For that reason, a single apparatus is provided with a plurality of process speeds, thus being adapted to these requirements.

However, in the image forming apparatus using the contact charging method in which the oscillating voltage is applied, in the case where the image forming apparatus is adapted to the plurality of process speeds, there arise the following three problems (A), (B) and (C).

(A) A first problem is an interference fringe which is called "moire image" occurring in the case where a (charging) frequency of the oscillating voltage applied to the charging member and a spatial frequency of a line pitch in line scanning with an exposure means (electrostatic latent image forming means) coincide with each other. With respect to this phenomenon, e.g., such a counter measure that a charging frequency fp is made sufficiently larger than a spatial frequency fs can be considered but there is a detrimental effect of an increase of a charging noise with an increase of the charging frequency.

(B) A second problem is a periodical "developing non-uniformity" occurring in the case where the (charging) frequency of the oscillating voltage applied to the charging member is equal or close to an integral multiple multiple of or an integral submultiple of the frequency of the oscillating voltage applied to a developing sleeve of a developing means. The developing non-uniformity occurs when the charging frequency is about the integral multiple of or the integral submultiple of the frequency of the oscillating voltage applied to the developing sleeve. Further, this is basically non-uniformity of a surface potential of the image bearing member and therefore discrimination of the non-uniformity is easy in the case where an image with a high resolution is formed (printed), so that there is a tendency to increase a range of the charging frequency in which the developing non-uniformity occurs. Further, particularly in the case where the charging means and the developing means are integrally supported to prepare a process cartridge detachably mountable to the main assembly of the image forming apparatus, there was the case where an abnormal image similar to the above-described image non-uniformity was caused to occur. This may be attributable to a phenomenon that an electroconductive path in which a developing voltage is supplied to the developing sleeve is disposed in the neighborhood of an electroconductive path in which a charging voltage is supplied to the charging member in some cases from the viewpoint of contacts with respect to the apparatus main assembly and therefore both of the voltages interfere with each other through stay capacitance to generate a beat component with respect to each of the voltages.

(C) A third problem is the following phenomenon due to no change in charging frequency in spite of a change in process speed. That is, when the process speed is slow, the number per unit area of electric discharge to which the image bearing member is subjected to increased, so that the image flow and blur in a high humidity environment and the deterioration and abrasion of the image bearing member are accelerated. On the other hand, when the process speed is fast, the number of electric discharge is decreased, so that sufficient charging cannot be effected to cause the occurrences of charging non-uniformity, charging failure, and the like. With respect to this problem, a change in charging frequency with the same ratio as that of the process speed can be considered.

With respect to the first to third problems, in the case where the process speed is changed, the change in charging frequency is desired. Therefore, it is considered that a combination of the change in charging frequency and the above-described discharge current control method is effective in order to provide a high quality image in the image forming apparatus in which the discharge current is variable.

However, even at the same peak-to-peak voltage of the oscillating voltage, the AC current value is decreased when the frequency is decreased, and is increased when the frequency is increased. For this reason, when the discharge current control is intended to be effected in the image forming apparatus in which the charging frequency is changed depending on the process speed, a range of the AC current value to be measured is extended. Further, when the measurement is performed in a wide range with reliability, an increase in cost due to electronic components used is caused. Further, when the AC current value is measured inexpensively, it leads to a lowering in measurement accuracy.

Further, when the discharge current control is effected at each of the process speeds, an operation time other than a time for an image forming operation is increased, so that there is possibility of an occurrence of a lowering in usability.

Here, JP-A 2002-182455 proposes the following method. That is, in the case of using the discharge current control method, such a method that from a result of determination of a peak-to-peak voltage of the (charging) AC voltage to be applied to the charging member at one of the plurality of process speeds, peak-to-peak voltages of the charging AC voltages for other all process speeds are calculated is employed.

The method of JP-A 2002-182455 is based on the premise that a relationship between the electric discharge current ($\Delta Iac$) and the peak-to-peak voltage (Vpp) of the charging AC voltage is constant when the same charging frequency is used. However, with respect to the high voltage power source mounted in the image forming apparatus, it is difficult to obtain similarity of waveform due to a fluctuation in electrostatic capacity in some cases from the viewpoint of the cost. For that reason, in the case where the charging AC voltages with different frequencies are applied to the charging member, the waveform of the charging AC voltage can vary depending on the change in electrostatic capacity. Further, it was found that at the different frequencies, relationships between the electric discharge current amount and the peak-to-peak voltage ($\Delta Iac$–Vpp characteristics) were different.

As a result, when a control voltage (Vpp) determined at one charging frequency is applied to an operation in which the different charging frequencies are used, deviation from an estimated discharge current charging member ($\Delta Iac$) can be caused to occur. For example, in the case where an unnecessarily high current flows, there can arise the problems of the occurrence of the image flow and the decrease in lifetime of the image bearing member. On the other hand, in the case where a low current flows, the image defect due to the charging failure can be caused to occur.

SUMMARY OF THE INVENTION

A principal object of the present invention is to provide an image forming apparatus, using different charging frequencies adapted to different process speeds, capable of setting a proper charging voltage while suppressing a lowering in productivity of an image.

According to an aspect of the present invention, there is provided an image forming apparatus comprising:

a rotatable photosensitive member;

a charging member for electrically charging the photosensitive member;

applying means for applying to the charging member a charging bias in the form of a DC voltage biased with an AC voltage;

forming means for forming an image on the charged photosensitive member;

detecting means for detecting a current passing between the charging member and the photosensitive member;

executing means for selectively executing a first image forming mode in which the charging bias in the form of the DC voltage biased with the AC voltage of a first frequency is applied to the charging member and the image is formed on the photosensitive member rotated at a first speed and a second image forming mode in which the charging bias in the form of the DC voltage biased with the AC voltage of a second frequency is applied to the charging member and the image is formed on the photosensitive member rotated at a second speed;

calculating means for calculating information indicating a relationship between an output of the detecting means when the AC voltage of the first frequency is applied to the charging member and an output of the detecting means when the AC voltage of the second frequency is applied to the charging member; and adjusting means for adjusting a peak-to-peak voltage value of the AC voltage to be applied to the charging member in the first image forming mode on the basis of the output of the detecting means obtained by applying the AC voltage of the first frequency to the charging member and for adjusting a peak-to-peak voltage value of the AC voltage to be applied to the charging member in the second image forming mode on the basis of the output of the detecting means obtained by applying the AC voltage of the first frequency to the charging member and the information, indicating the relationship, calculated by the calculating means.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the image forming apparatus according to the present invention will be described with reference to the drawings.

Embodiment 1

1. General Structure of Image Forming Apparatus

Figure 1:
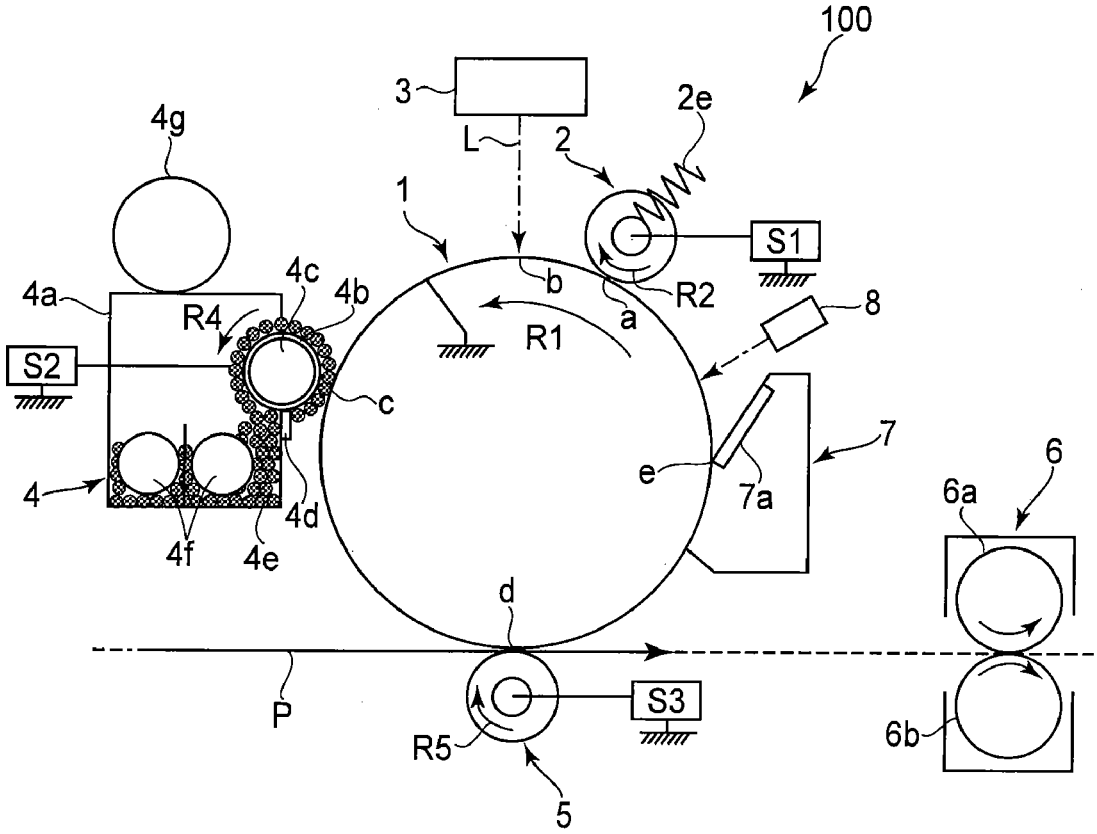
FIG. 1 is a schematic structural view of an image forming apparatus in Embodiment 1 of the present invention.

FIG. 1 is a schematic view for illustrating an example of a general structure of the image forming apparatus according to the present invention. In this embodiment, an image forming apparatus is a laser beam printer which utilizes a transfer type electrophotographic process, which employs a contact charging method and a reverse development method, and which has an A3 size as a maximum sheet passing size.

The image forming apparatus 100 includes a rotatable drum-type photosensitive member (electrophotographic photosensitive member) i.e., a photosensitive drum 1. The photosensitive drum 1 is rotationally driven in a direction indicated by an arrow R1 (counterclockwise direction). Around the photosensitive drum 1, along the rotational direction of the photosensitive drum 1, the following means are disposed. That is, the means include a charging device (a roller charger) 2 as a contact charging member which is a charging means, a developing device 4 as a developing means, a transfer roller 5 as a contact transfer member which is a transfer means, and a cleaning device 7 as a cleaning means. Above a space between the charging roller 2 and the developing device 4, an exposure device 3 as an exposure means (electrostatic latent image forming means) is provided. Further, a fixing device 6 as a fixing means is provided on a downstream side of a transfer portion d, formed between the photosensitive drum 1 and the transfer roller 5, with respect to a conveying direction of a transfer material P.

Figure 2:
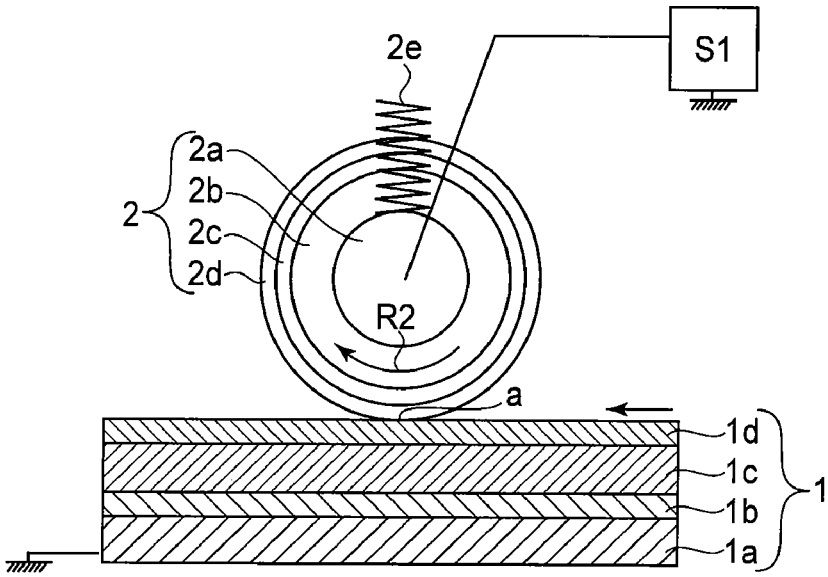
FIG. 2 is a schematic sectional view of layer structures of a photosensitive drum and a charging roller in the image forming apparatus in Embodiment 1 of the present invention.

The photosensitive drum 1 is a negatively chargeable organic photoconductor (OPC) photosensitive member having an outer diameter of 30 mm in this embodiment. The photosensitive drum 1 is rotationally driven, by a driving device such as a motor as a driving means, at a process speed (corresponding to a peripheral speed of the photosensitive drum 1 in this embodiment) of 300 mm/sec in the direction indicated by the arrow R1 (counterclockwise direction). The photosensitive drum 1 is, as shown in FIG. 2, constituted by coating three layers consisting of an undercoat layer 1*b* for improving adhesiveness to upper layer while suppressing interference of light, a photocharge generating layer 1*c*, and a charge transporting layer 1*d* in this order on the surface of an aluminum-made cylinder (electroconductive drum substrate) 1*a*.

The charging roller 2 is rotatably held by shaft-supporting members at both end portions of its core metal 2*a* and is urged toward a center direction of the photosensitive drum 1 by an urging spring 2*e* as an urging means, thus being urged against the photosensitive drum 1 with a predetermined urging force. The charging roller 2 is rotated in a direction indicated by an arrow R2 (clockwise direction) by the rotational drive of the photosensitive drum 1. A press-contact portion between the photosensitive drum 1 and the charging roller 2 is a charge portion (charging nip) a.

To a core metal 2*a* of the charging roller 2, a charging voltage (charging bias) is applied from a charging power source S1 as a charging voltage applying means (bias applying means) under a predetermined condition, so that the peripheral surface of the photosensitive drum 1 is contact-charged to a predetermined polarity and a predetermined potential. In this embodiment, the charging bias voltage applied to the charging roller 2 is an oscillating voltage in the form of a DC voltage (Vdc) biased with an AC voltage (Vac). More specifically, the charging voltage is the oscillating voltage in the form of the DC voltage of −500 V biased with the AC voltage of a frequency of 2 kHz, and the peripheral surface of the photosensitive drum 1 is contact-charged uniformly to −500 V (dark potential: Vd).

The exposure device 3 is a laser beam scanner using a semiconductor laser in this embodiment. The exposure device 3 outputs laser light (beam) modulated correspondingly to an image signal input from a host processing device such as an image reading device (not shown) and subjects the uniformly charged surface of the photosensitive drum 1 to scanning exposure (image exposure) to light L at an exposure position b. By this scanning exposure to light L, the potential of the surface of the photosensitive drum 1 at a portion which has been irradiated with the laser light L is lowered, so that an electrostatic latent image (electrostatic image) is successively formed on the photosensitive drum 1 surface correspondingly to image information obtained by the scanning exposure to light L.

The developing device 4 is a reverse-developing device of a two-component magnetic brush developing type in this embodiment and deposits toner on an exposed portion (light portion) of the photosensitive drum 1 surface to reversely develop the electrostatic latent image on the photosensitive drum 1 surface. That is, by depositing the toner charged to the same polarity as that of the photosensitive drum 1 at a portion where electric charges are attenuated by exposure of the photosensitive drum 1 to light, the development is effected. The developing device 4 includes a developing container 4*a*, a rotatable non-magnetic developing sleeve 4*b* as a developer carrying member which is provided at an opening of the developing container 4*a*, and a fixed magnet roller 4*c* contained in the developing sleeve 4*b*. A developer 4*e* in the developing container 4*a* is coated in a thin layer on the developing sleeve 4*b*. The developing sleeve 4*b* conveys the coated developer to a developing portion c where the developing sleeve 4*b* opposes the photosensitive drum 1. The developer 4*e* in the developing container 4*a* is a mixture of the non-magnetic toner and a magnetic carrier and is conveyed toward the developing sleeve 4*b* while being stirred uniformly by rotation of two developer-stirring members 4*f*. In this embodiment, the magnetic carrier has a resistivity of about $10^{13}$ ohm·cm and a particle size of 40 μm, and the toner is triboelectrically charged to a negative polarity by friction with the magnetic carrier. The toner content (concentration) in the toner container 4*a* is detected by a concentration sensor (not shown). On the basis of this detected information, the toner is supplied in an appropriate amount from a toner hopper 4*g* to the developing container 4*a*, so that the toner content is adjusted at a constant level.

The developing sleeve 4*b* is provided closely and oppositely to the photosensitive drum 1 while keeping the closest distance with respect to the photosensitive drum 1 at 300 μm at the developing portion c. The developing sleeve 4*b* is rotationally driven (in a direction indicated by an arrow R4) so that the surface thereof means in a direction opposite from a surface movement direction of the photosensitive drum 1 at the developing portion c. To the developing sleeve 4*b*, a predetermined developing voltage (developing bias) is applied from a developing power source S2 as a developing voltage applying means. In this embodiment, the developing voltage applied to the developing sleeve 4*b* during the development is the oscillating voltage in the form of a DC voltage (Vdc) biased with an AC voltage (Vac). More specifically, in this embodiment, the developing bias voltage is the oscillating voltage in the form of the DC voltage (−350 V) biased with the AC voltage having the peak-to-peak voltage of 8 kV.

The transfer roller 5 press-contacts the photosensitive drum 1 with a predetermined urging force to form the transfer portion d. Further, to the transfer roller 5, a transfer voltage (transfer bias) is applied from a transfer power source S3 as a transfer voltage applying means. More specifically, the transfer voltage of a positive polarity opposite from the negative polarity as a normal charge polarity of the toner (+500 V in this embodiment) is applied to the transfer roller 5. As a result, at the transfer portion d, a toner image on the photosensitive drum 1 surface is transferred onto the transfer material P such as a sheet (paper) as a second image bearing member (member onto which the toner image is to be transferred).

The fixing device 6 includes a rotatable fixing roller 6*a* and a rotatable pressing roller 6*b*, and heat-presses the toner image transferred on the surface of the transfer material P while nip-conveying the transfer material P at a fixing nip between the fixing roller 6*a* and the pressing roller 6*b*, thus heat-fixing the toner image.

The cleaning device 7 includes a cleaning blade 7*a* as a cleaning member. The surface of the photosensitive drum 1 after the toner image transfer onto the transfer material P is rubbed with the cleaning blade 7*a* of the cleaning device 7 to be subjected to removal of untransferred toner deposited thereon, thus being cleaned. Then, the photosensitive drum 1 is subjected to image formation repeatedly. In FIG. 1, a reference symbol e represents a press-contact portion of the cleaning blade 7*e* with respect to the surface of the photosensitive drum 1.

2. Charge of Process Speed

The image forming apparatus in this embodiment is media-flexible and adapted to various types of media (recording materials) such as the thick paper and the OHP sheet. However, the thick paper and the OHP sheet have a large thermal capacity, so that it is difficult to fix the toner image. Therefore, when the toner image is fixed to a normal process speed with respect to plain paper, there can arise a problem that a light-transmitting property of the unfixed image or the OHP sheet is lowered.

In view of this problem, in this embodiment, a method in which the toner image is fixed under sufficient pressure in a sufficient fixing time by slowing down a conveying speed of the recording material P at the time when the recording material P passes through the fixing device 6 is employed. However, it is difficult to slow down the conveying speed only in the fixing device 6 from the viewpoint of the increase in cost and an apparatus constitution, so that a method in which the process speed of the image forming apparatus as a whole is slowed down is employed.

More specifically, the image forming apparatus 100 in this embodiment is operable, in addition to a normal mode (normally speed mode) with respect to the plain paper, ½ speed mode and ¼ speed mode in which the image forming apparatus is adapted to special paper such as the thick paper or the OHP sheet. In the ½ speed mode and the ¼ speed mode, the process speed is changed from 300 mm/sec in the normal speed mode to 150 mm/sec and 75 mm/sec, respectively.

Correspondingly, the frequency of the AC voltage applied to the charging roller 2 is also changed to 2 kHz in the normal speed mode, 1 kHz in the ½ speed mode, and 500 Hz in the ¼ speed mode. The image forming apparatus include an executing means for executing these image forming modes in a switching manner.

3. Operation Sequence of Image Forming Apparatus

Figure 3:
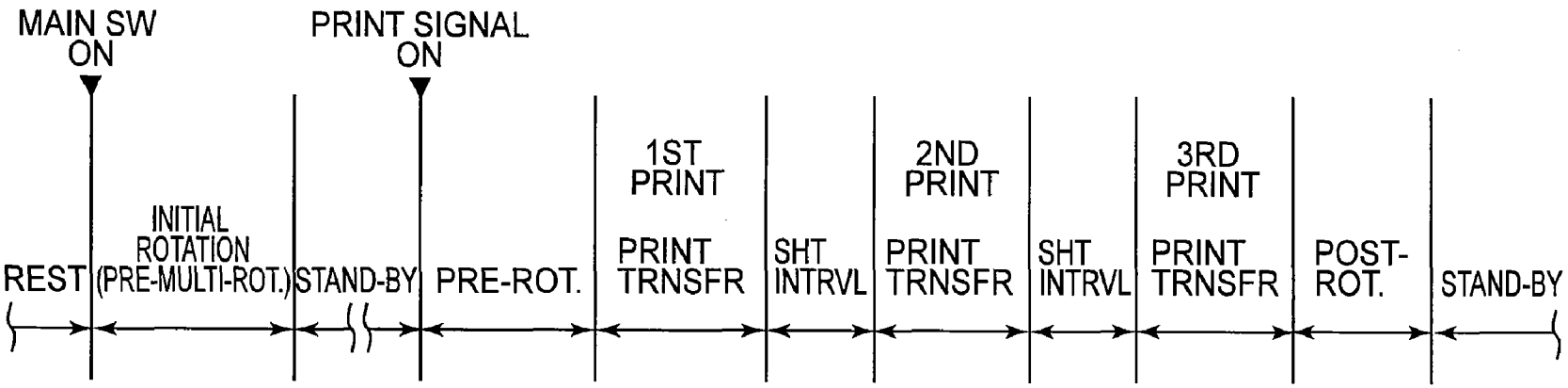
FIG. 3 is a diagram for illustrating an operation sequence of the image forming apparatus.

FIG. 3 shows an operation sequence of the above-described image forming apparatus 100. The respective operation steps will be described below more specifically.

a. Initial Rotation Operation (Pre-Multi-Rotation Step)

In an actuation operation period (warm-up period) during actuation of the image forming apparatus 100, the photosensitive drum 1 is rotationally driven by turning a (main) power switch on and preparatory operations of predetermined process devices (equipment) such as warm-up of the fixing device 6 to a predetermined temperature are executed.

b. Preparatory Rotation Operation for Printing (Pre-Rotation Step)

In a preparatory rotation operation period, before image formation, from print signal input until an image forming (printing) step operation is actually performed, this operation is executed in succession to the initial rotation operation when the print signal is input during the initial rotation operation. When the print signal is not input, the drive of the main motor is once interrupted, after the initial rotation operation is completed, to stop the rotational drive of the photosensitive drum 1, so that the image forming apparatus 100 is kept in a stand-by (waiting) state until the print signal is input. When the print signal is input, the preparatory rotation operation for printing is executed. In this embodiment, in this preparatory rotation operation period for printing, an arithmetic computation and determination program for an appropriate peak-to-peak voltage value of the applied AC voltage (or the AC current value) in a charging process in a printing step is executed. This will be described later.

c. Printing Step (Image Forming Step)

When the preparatory rotation operation for printing is completed, an image forming process with respect to the rotating photosensitive drum is carried out and then the toner image formed on the photosensitive drum 1 surface is transferred onto the transfer material P and fixed by the fixing device 6, so that an image-formed product is output to the outside of the apparatus.

In the case of a continuous printing mode, the above-described printing step is repeatedly performed correspondingly to a pre-set number of sheets (n sheets).

d. Sheet Interval Step

This step corresponds to a non-sheet-passing state period of the transfer material P from after a trailing end of a transfer material P passes the transfer position d until a leading end of a subsequent transfer material P reaches the transfer position d.

e. Post-Rotation Operation

In a predetermined period, the post-rotation operation is performed in a manner such that the main motor drive is continued for a time, even after the printing step for a final transfer material P is completed, to rotationally drive the photosensitive drum, thus performing a predetermined post-operation.

f. Stand-By

When the predetermined post-operation is completed, the main motor drive is stopped to stop the rotational drive of the photosensitive drum and then the image forming apparatus 100 is kept in a stand-by state until a subsequent print start signal is input. In the case of printing on only one sheet, after completion of the printing, the image forming apparatus 100 is in a stand-by state after completion of the post-rotation operation. In the stand-by state, when the print start signal is input, the image forming apparatus 100 goes to the pre-rotation step.

During the above-described c. Printing step corresponds to during image formation. Further, during the above-described a. Initial operation, b. Preparatory rotation operation for printing, d. Sheet interval, and e. Post-rotation operation corresponds to during non-image formation.

4. Charging Roller

In this embodiment, the charging roller 2 has a length of 320 mm with respect to its longitudinal direction. As shown in FIG. 2, the charging roller 2 has, around the core metal (supporting member) 2*a*, three-layer structure consisting of a lower layer 2*b*, an intermediary layer 2*c*, and a surface layer 2*d* which are successively laminated in this order. The lower layer 2*b* is a foam sponge layer for decreasing charging noise, and the surface layer 2*d* is a protective layer provided for preventing an occurrence of leakage even when a pin hole (low resistance portion) is present on the photosensitive drum 1.

More specifically, the charging roller 2 in this embodiment has the following specification.

Core metal 2*a*: stainless steel rod with a diameter of 6 mm

Lower layer 2*b*: carbon-dispersed foam EPDM (specific gravity: 0.5 g/cm$^3$, volume resistivity: $10^2$-$10^9$ ohm·cm, layer thickness: 3.0 mm)

Intermediary layer 2*c*: carbon-dispersed NBR rubber (volume resistivity: $10^2$-$10^5$ ohm·cm, layer thickness: 700 μm)

Surface layer 2*d*: fluorinated "Torejin" resin in which tin oxide and carbon particles are disposed (volume resistivity: $10^7$-$10^{10}$ ohm·cm, surface roughness (JIS ten-point average surface roughness Ra): 1.5 μm, layer thickness: 10 μm)

The above-described charging roller is brought into contact with the photosensitive member (drum) to electrically charge the photosensitive member.

5. Block Diagram

Figure 4:
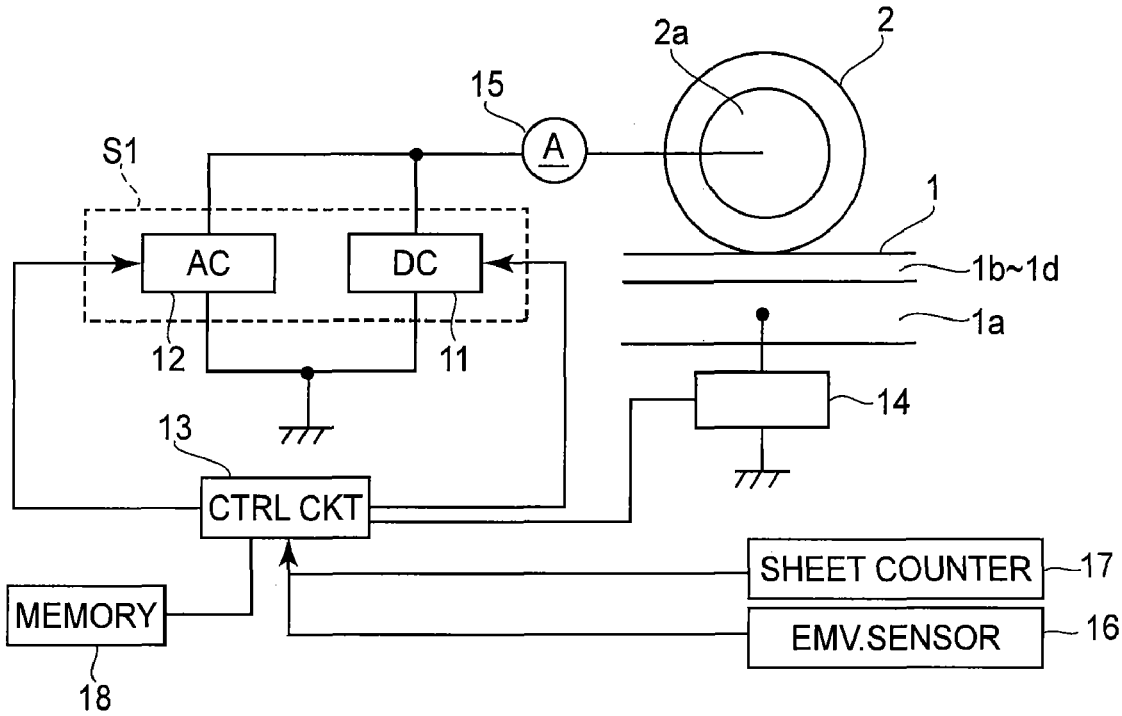
FIG. 4 is a block circuit diagram of a charging bias applying system in the image forming apparatus in Embodiment 1 of the present invention.

FIG. 4 is a block diagram of a charging voltage applying system with respect to the charging roller 2. The peripheral surface of the rotating photosensitive drum 1 is electrically charged to a predetermined potential by applying a predetermined oscillating voltage in the form of a DC voltage biased with an AC voltage having a predetermined frequency (Vdc+Vac) from the charging power source S1 to the charging roller 2 through the core metal 2*a*. The power source S1 as a voltage applying means with respect to the charging roller 2 includes a DC power source 11 and an AC power source 12.

A control circuit 13 has the function of controlling the charging power source S1 so that the charging roller 2 is supplied with either one of the DC voltage and the AC voltage or supplied with the oscillating (superposed) voltage in the form of the DC voltage biased with the AC voltage by effecting ON/OFF control of the DC power source 11 and the AC power source 12. The control circuit 13 further has the function of controlling a value of the DC voltage to be applied from the DC power source 11 to the charging roller 12 and a value of peak-to-peak voltage or AC current of the AC voltage to be applied from the AC power source 12 to the charging roller 2.

To the control circuit 13, information on an AC current value (or peak-to-peak voltage value) measured by an AC current value (or peak-to-peak voltage value) measuring circuit 14 as a first detecting means for measuring the value of the AC current passing through the charging roller 2 via the photosensitive drum 1 is input from the measuring circuit 14.

Further, to the control circuit 13, from a DC current value measurement circuit 15 as a third detecting means for measuring a value of DC current passing through the charge roller 2 via the photosensitive drum 1, measured DC current value information is input. Further, to the control circuit 13, detected environmental information is input from an environment sensor (thermometer and hygrometer) 16 as an environment detection means for detecting the environment in which the image forming apparatus 100 is disposed. Further, to the control circuit 13, from a sheet number counter 17, as a usage detecting means, for counting the number of sheets subjected to image output, detected sheet number information is input. Then, the control circuit 13 has the function of executing an operating and determining program of the appropriate peak-to-peak voltage value of the AC voltage applied to the charging roller 2 in the charging step in the printing process, on the basis of the following information. That is, the information includes the AC current value information (or peak-to-peak voltage value information) input from the AC current value (or peak-to-peak voltage value) measuring circuit (hereinafter referred to as "AC current value measuring circuit) 14 and the DC current value information input from the DC current value measuring circuit 15, and further includes the environmental information input from the environment sensor 16 and the sheet number information input from the sheet number counter 17.

6. Bias Control

A control method of the peak-to-peak voltage of the AC voltage to be applied to the charging roller 2 during the printing process will be described below.

Figure 5:
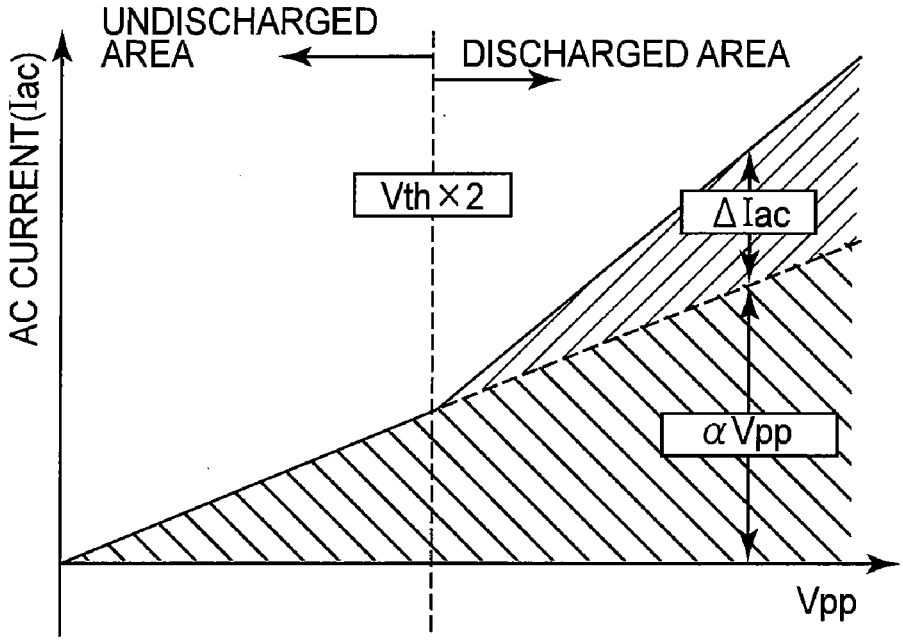
FIG. 5 is a graph for illustrating electric discharge current control.

The present inventor has found, from various studies, that a discharge current value converted into numerical value according to a definition described below is used as a substitution for an actual amount of AC discharge and strongly correlated with abrasion of the photosensitive drum 1, image flow, and charging uniformity. As shown in FIG. 5, an AC current Iac has a linear relation to a peak-to-peak voltage Vpp of the charging AC voltage in an area less than Vth×2 (V) (undischarged area) and is then linearly increased gradually in a discharged area with an increasing peak-to-peak voltage value. In a similar experiment in a vacuum, the linearity of Iac is kept also in the discharged area, so that the resultant increment of Iac is regarded as a discharge current increment ΔIac.

When a ratio of the AC current Iac to the peak-to-peak voltage Vpp in the undischarged area less than Vth×2 (V) is taken as α, an AC current, other than the current due to discharge, such as a current flowing through a contact portion between the charging member and a member to be charged (hereinafter referred to a "nip current") is represented by α·Vpp. A difference ΔIac between the current value Iac measured during the application of a voltage equal to or more than Vth×2 (V) and the above value α·Vpp calculated according to the following formula 1 is defined as discharge current amount as a substitution for a discharge amount.

$$\Delta Iac = Iac - \alpha \cdot Vpp \quad \text{(formula 1)}$$

The discharge current amount is changed depending on a change in environmental condition and an increase in amount of usage of the image forming apparatus in the case of performing the charging under control with a constant voltage or with a constant current. This is because a relationship between the peak-to-peak voltage and the discharge current amount and a relationship between the AC current value and the discharge current amount are changed.

Here, in an AC constant current control method, the charging of the member to be charged is controlled by a total amount of current flowing from the charging member to the member to be charged. The total current amount is, as described above, a sum of the nip current α·Vpp and the discharge current amount ΔIac which is carried by the discharge at the non-contact portion. In the constant current control method, the charge control is effected by current including not only the discharge current which is current necessary to actually charge electrically the member to be charged but also the nip current.

For this reason, the discharge current amount ΔIac cannot be actually controlled. In the constant current control method, even in the case of effecting control at the same current value, depending on an environmental change of a material for the charging member, the discharge current amount is decreased when the nip current is increased and is increased when the nip current is decreased. For this reason, it is difficult to sufficiently suppress a change (increase/decrease) in discharge current amount even by the AC constant current control method. When the lifetime of the image forming apparatus is intended to be prolonged, it is difficult to compatibly realize abrasion resistance of the photosensitive drum 1 and the charging uniformity.

In this embodiment, in order to always obtain a desired discharge current amount, the control was effected in the following manner.

When the desired discharge current amount is taken as D, a method of determining the peak-to-peak voltage providing the discharge current amount D will be described.

In this embodiment, during the preparatory rotation operation for printing, the operating and determining program for the appropriate peak-to-peak voltage value of the AC voltage to be applied to the charging roller 2 in the charging step during the printing process is executed by the control circuit 13.

Figure 6:
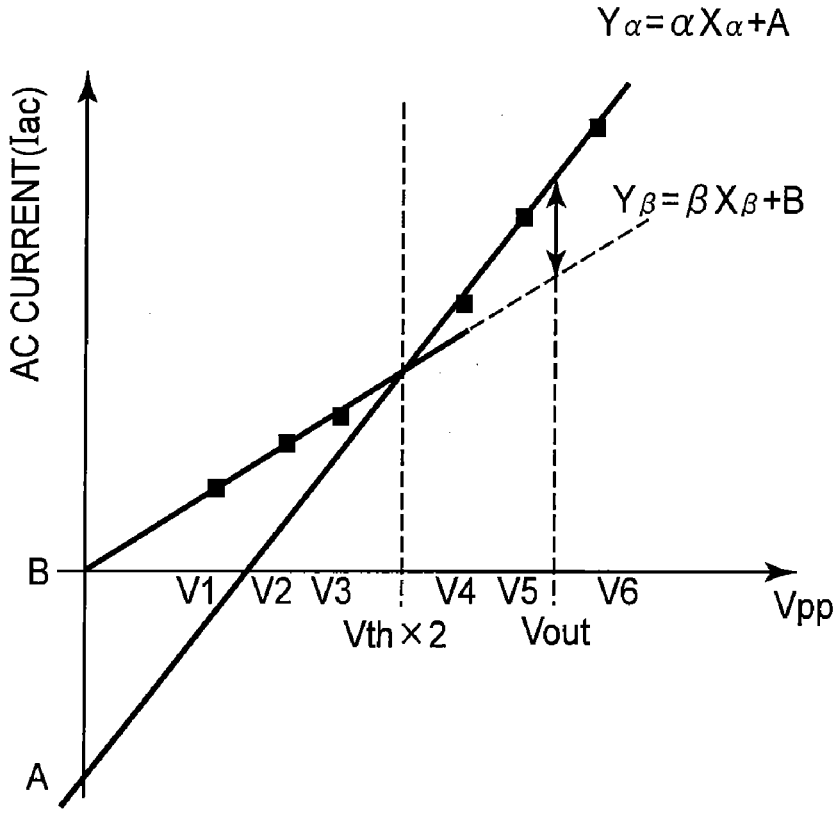
FIG. 6 is a graph showing an example of a relationship between a peak-to-peak voltage and AC current.
Figure 7:
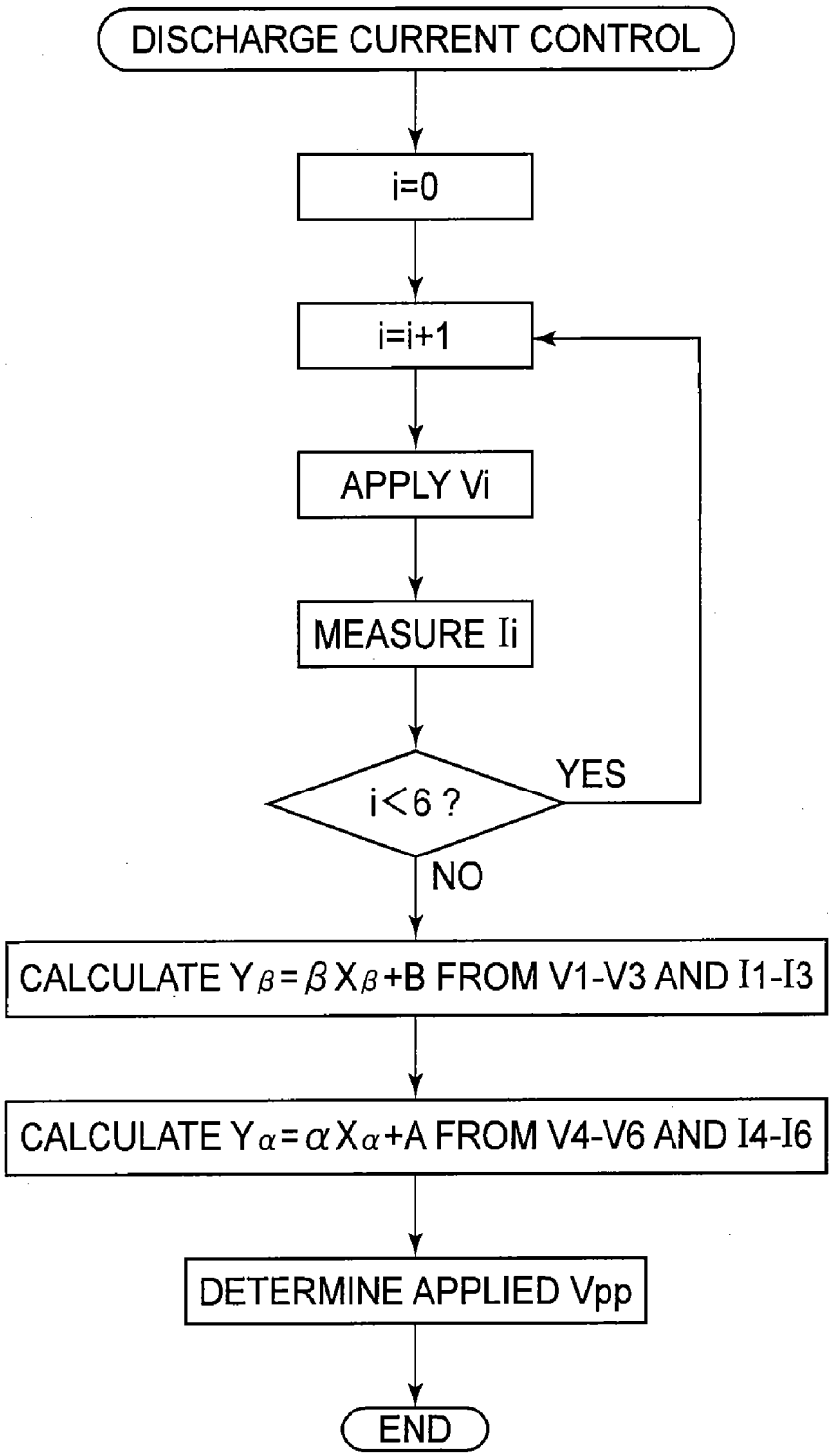
FIG. 7 is a flowchart for illustrating the discharge current control.

FIG. 6 shows a relationship between the peak-to-peak voltage Vpp of the charging AC voltage and the AC current Iac for illustrating the control in this embodiment (Vpp-Iac graph) and FIG. 7 shows a control flowchart of the control.

The control circuit 13 controls the AC power source 12 during the pre-rotation operation so that three values of peak-to-peak voltages (Vpp) of the AC voltages in the discharged area and three values of peak-to-peak voltages (Vpp) of the AC voltages in the undischarged area are successively applied to the charging roller 2. The resultant values of AC current flowing into the charging roller 2 via the photosensitive drum 1 are measured by the AC current value measuring circuit 14 and input into the control circuit 13.

Next, the control circuit 13 performs collinear approximation of a relationship between the peak-to-peak voltage and the AC current in the discharged area and the undischarged area, respectively, on the basis of the three measured values in the discharged area and the three measured values in the undischarged area by using least square method to obtain the following formulas 2 and 3.

(Approximated Line in Discharged Area)

$$Y_\alpha=\alpha X_\alpha+A \quad \text{(formula 2)}$$

(Approximated Line in Undischarged Area)

$$Y_\beta=\beta X_\beta+B \quad \text{(formula 3)}$$

Thereafter, the peak-to-peak voltage Vpp corresponding to the discharge current amount D is determined by formula 4 below as a difference between the approximated line in the discharged area (formula 2) and the approximated line in the undischarged area (formula 3).

$$Vpp=(D-A+B)/(\alpha-\beta) \quad \text{(formula 4)}$$

Then, the peak-to-peak voltage of the AC voltage applied to the charging roller 2 is switched to the Vpp obtained by the above formula (4). Thereafter, the constant voltage control is effected and then the procedure goes to the printing step.

Thus, the peak-to-peak voltage value (control voltage value) of the charging AC voltage necessary to obtain the predetermined discharge current amount during the printing every time of the preparatory rotation operation for printing is calculated, and during the printing, the AC voltage of the obtained peak-to-peak voltage is applied to the charging roller 2 by the constant current control.

As a result, it was possible to absorb manufacturing variation of the charging roller 2, fluctuation in electric resistance value due to an environmental change in material for the charging roller 2, and variation in high-voltage device of the apparatus main assembly, so that it became possible to obtain a desired discharge current amount with reliability. Such control is referred herein to as "discharge current amount control". This discharge current amount control is effected by the control circuit as a calculating means provided to the image forming apparatus.

7. Process Speed and Discharge Current Control

As described above, in the image forming apparatus having the plurality of process speeds, when the discharge current control is effected at each of the process speeds, there arises the problem that the operation time other than the time for the image forming operation is increased.

In order to solve this problem, the following control is proposed in JP-A 2002-182455. Specifically, such a method that from a result of determination of a peak-to-peak voltage of the (charging) AC voltage to be applied to the charging member at one of the plurality of process speeds, peak-to-peak voltages of the charging AC voltages for other all process speeds are calculated is proposed.

This method is based on the premise that the relationship between the electric discharge current (ΔIac) and the peak-to-peak voltage (Vpp) of the charging AC voltage is constant when the same charging frequency is used. However, with respect to the high voltage power source mounted in the image forming apparatus, it is difficult to obtain similarity of waveform due to a fluctuation in electrostatic capacity in some cases from the viewpoint of the cost. Further, at the different frequencies, relationships between the electric discharge current amount and the peak-to-peak voltage (ΔIac–Vpp characteristics) are different in some cases using an inexpensive high-voltage source.

As a result, deviation from an estimated discharge current charging member (ΔIac) can be caused to occur, so that the decrease in lifetime of the photosensitive drum 1 and the image defect due to the charging failure can occur. As described above, the principal object of the present invention is to provide an image forming apparatus, using different charging frequencies adapted to different process speeds, capable of setting a proper charging voltage while suppressing a lowering in productivity of an image. Another object of the present invention is to provide proper discharge current without effecting discharge current control at each of the process speeds in the image forming apparatus in which the discharge current control is effected and the plurality of process speeds is settable.

In this embodiment, the image forming apparatus 100 can execute normal discharge current control in which a plurality of times of discharge current control is effected by switching the frequency at a single process speed and simple discharge current control in which the discharge current control is effected at a single frequency and a single process speed. A ratio between proper voltages at different frequencies is calculated as a correction value during the normal discharge current control and a control result of the simple discharge current control is multiplied by the ratio (correction value) to determine a control voltage value at other frequencies. This will be described more specifically.

The discharge current control is effected by using a predetermined process speed and a frequency of the charging AC voltage corresponding to the predetermined process speed. In this case, in order to reduce a down time (in which the image output cannot be performed), it is desirable that the control is effected at the highest process speed. Therefore, in this embodiment, the discharge current control is effected at 300 mm/sec which is the highest process speed of the plurality of process speeds set in the image forming apparatus 100. When similar control is effected at a process speed lower than that in the normal mode, e.g., the control time is two times, that in the normal mode, in the ½ speed mode and is four times, that in the normal mode, in the ¼ speed mode. Further, as described above, it is difficult to apply the control result at the process speed of 300 mm/sec in the normal mode to the ½ speed mode and the ¼ speed mode as it is.

Further, the high-voltage output portion mounted in the image forming apparatus 100 is capable of outputting a necessary waveform with respect to a load such as an estimated electrostatic capacity or electric resistance but in the case where the load is considerably fluctuated, it is difficult to keep the similarity of the waveform. When the waveform similarity is intended to be maintained, the circuit is complicated and the cost therefor is increased in some cases.

Figure 8:
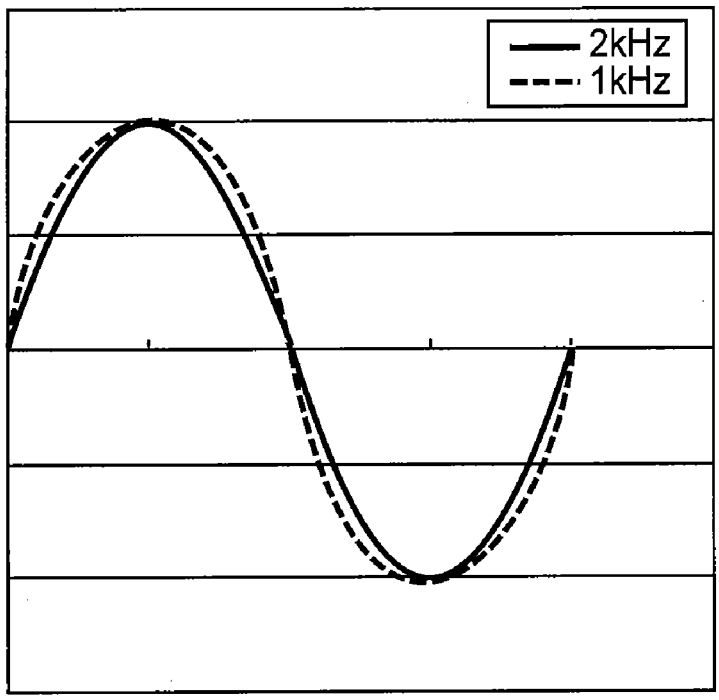
FIG. 8 is a graph for illustrating a change in AC waveform.

When the charging frequency is changed, the electrostatic capacity at the discharged portion is changed, so that a high-voltage output waveform is changed. The output waveform of the high-voltage source used in this embodiment was found that it changes as shown in FIG. 8. For this reason, when the frequency is decreased to ½ thereof, the same discharge current cannot be obtained even when the same AC voltage is applied to the charging roller 2. Therefore, when the result of the discharge current effected at 300 mm/sec which is the process speed in the normal mode is applied in the ½ speed mode and the ¼ speed mode, a discharge current error is increased.

In view of this problem, in this embodiment, the following control is effected, the case where the result of the discharge current control at 300 mm/sec is applied to the ½ speed more will be described. In this embodiment, as the discharge current control, two types thereof consisting of the normal discharge current control and the simple discharge current control are set.

Figure 9:
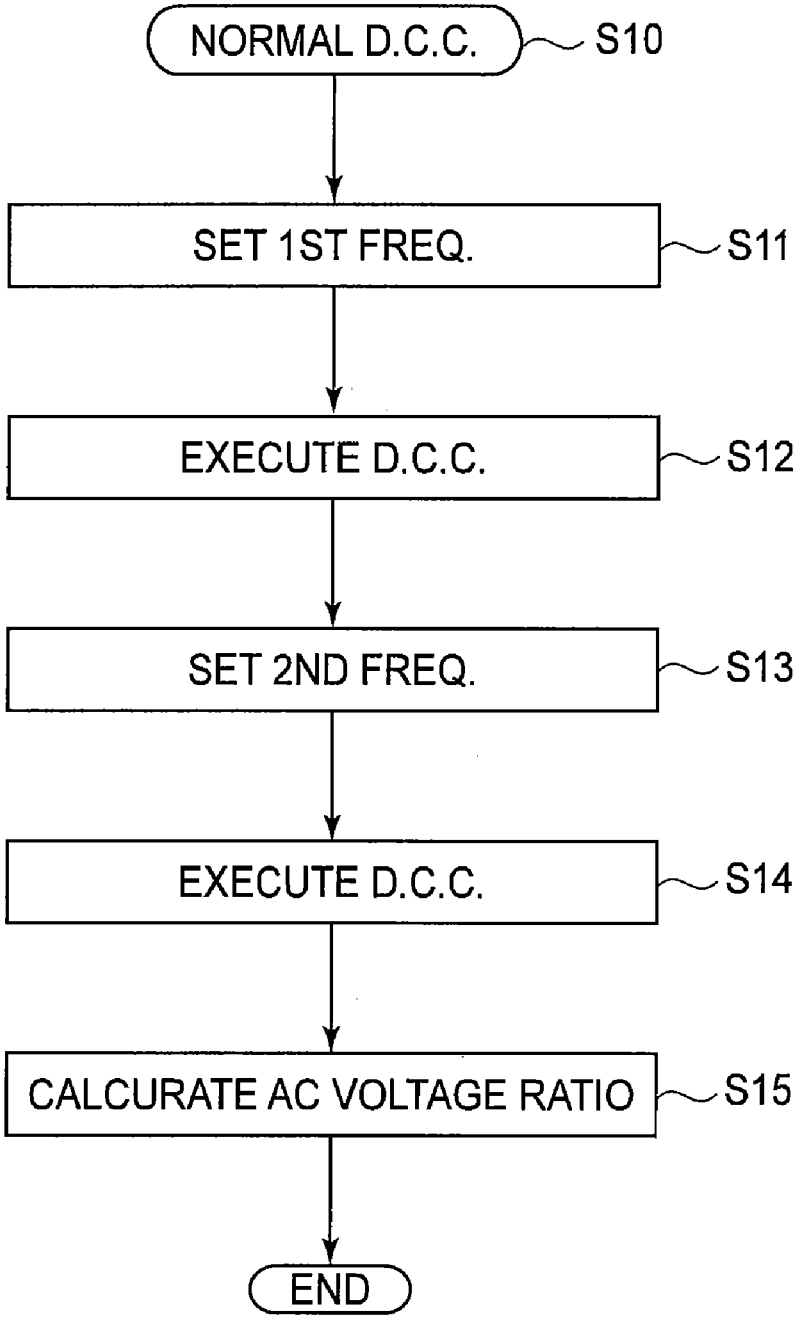
FIG. 9 is a flowchart showing an example of normal discharge current control in the present invention.

FIG. 9 shows a control flow of the normal discharge current control. The control circuit 13 starts the normal discharge current control with predetermined timing (S10) and then sets the process speed at 300 mm/sec and sets the charging frequency at 2 kHz as a first frequency (S11), thus effecting the discharge current control (S12). Thereafter, the control circuit 13 switches the charging frequency to 1 kHz as a second frequency while keeping the process speed at 300 mm/sec (S13), thus effecting discharge current control (S14). From two results of the discharge current at the above two frequencies, the control circuit 13 as the calculating means obtains two AC voltage values (control voltage values) providing the same discharge current and then calculates a ratio between the two AC voltage values as a correction value (S15). The calculated correction value is stored in a memory 18 contained in or connected to the control circuit 13. As the memory 18, it is possible to use a ROM.

In this embodiment, sampling of 6 peak-to-peak voltages is consisting of 3 peak-to-peak voltages of less than Vth×2 (V) and 3 peak-to-peak voltages of not less than Vth×2 (V) was made in one discharge current control. In the case of the normal discharge current control, this sampling of 6 peak-to-peak voltages is made at each of the two different charging frequencies, so that the sampling of 12 peak-to-peak voltages (6 peak-to-peak voltages×2) in total is made.

In this embodiment, the 6 sampled peak-to-peak voltages were V1=500 Vpp, V2=700 Vpp, V3=900 Vpp, V4=1500 Vpp, V5=1700 Vpp, and V6=1900 Vpp. Further, in this embodiment, a target value of the discharge current amount was 50 μA. In this embodiment, a normal discharge current control operation is performed every time during the initial rotation operation immediate after the main switch is turned on as shown in FIG. 3.

Figure 10:
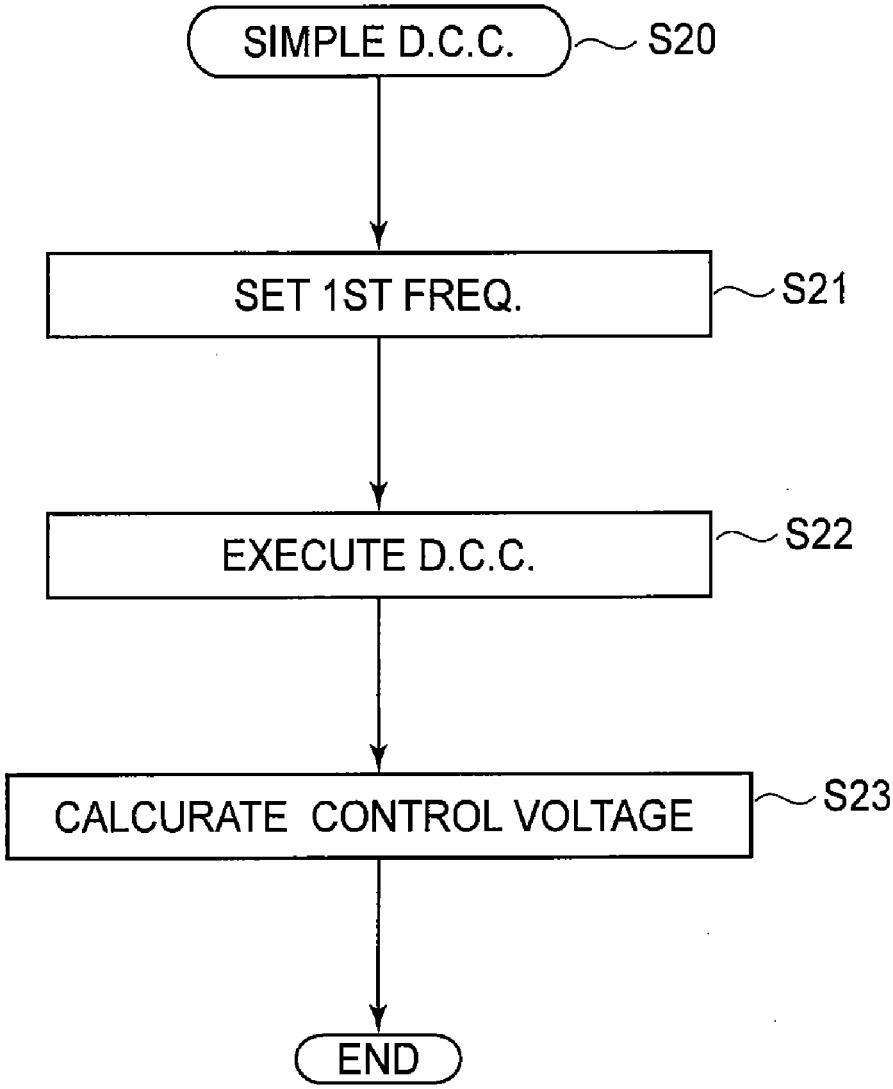
FIG. 10 is a flowchart showing an example of simple discharge current control in the present invention.

FIG. 10 shows a control flow of the simple discharge current control. The simple discharge current control is characterized in that the discharge current control at the second frequency is not effected. The control circuit 13 starts the simple discharge current control with predetermined timing (S20) and then sets the process speed at 300 mm/sec and sets the charging frequency at 2 kHz as the first frequency (S21), thus effecting the simple discharge current control (S22). Thereafter, the correction value obtained by the normal discharge current control is read from the memory 18 and the control circuit 13 calculates the product of the read correction value and the AC voltage value obtained in the simple discharge current control to determine the control voltage value at the second frequency (S23).

In this embodiment, as the peak-to-peak voltage (control voltage value) of the charging AC voltage during the image forming operation at the charging frequency of 2 kHz, a result of the latest discharge current control which is either one of the normal discharge current control and the simple discharge current control is used. On the other hand, the peak-to-peak voltage (control voltage value) of the charging AC voltage during the image forming operation at the charging frequency of 1 kHz is determined in the following manner. That is, immediately after the normal discharge current control, the control voltage value obtained by setting the charging frequency at 1 kHz in the normal discharge current control is used. Further, after the simple discharge current control is carried out, the control voltage value obtained by computation in the latest simple discharge current control is used.

In this embodiment, the simple discharge current control is carried out in the case where the count by the sheet (number) counter 17 (FIG. 4) exceeds 100 sheets and the procedure has gone to the post-rotation step (FIG. 3). Further, in this embodiment, the simple discharge current control is effected as interrupt control at sheet interval (FIG. 3) every 500 sheets of the count by the sheet counter 17 before the procedure goes to the post-rotation step.

As an example, the case where the image forming operation is performed continuously on 100 sheets at the process speed of 300 mm/sec and then performed at the process speed of 150 mm/sec (½ speed operation) will be described.

The initial rotation operation is performed by turning the main switch on and in this step, the normal discharge current control is effected. The result at the charging frequency of 2 kHz (first frequency) is 1480 Vpp (control voltage value V1) and the result at the charging frequency of 1 kHz (second frequency) is 1450 Vpp (control voltage value V2). In this case, the correction value which is the ratio between the control voltage values obtained at the respective charge frequencies is obtained according to the following equation:

$$V2/V1=1450/1480=0.98.$$

The resultant correction value of 0.98 is stored in the memory 18.

The initial image forming operation is completed when the sheet number reaches 100 sheets and then the procedure goes to the post-rotation step. When the sheet number information indicating that the count by the sheet counter 17 is 100 (sheets) is input into the control circuit 13, the control circuit 13 starts the simple discharge current control. The simple discharge current control is effected at the process speed of 300 mm/sec and the charging frequency of 2 kHz. When the result of the simple discharge current control is 1470 Vpp, the charging AC voltage value to be used in the image forming operation at the charging frequency of 1 kHz is obtained as follows:

$$1470\times0.98=1440\ Vpp.$$

The thus-obtained control voltage value of the charging AC voltage in the image forming operation at the charging frequency of 1 kHz is stored in the memory. Then, in a subsequent ½ speed operation, the image forming operation is performed at the above-obtained control voltage value of 1440 Vpp of the charging AC voltage in the image forming operation at the charging frequency of 1 kHz.

Here, in the case where if the simple discharge current control is not carried out, the image forming operation is performed at the control voltage value of 1450 Vpp previously obtained in the normal discharge current control, so that an excessive discharge current corresponding to 10 Vpp flows. For that reason, the lowering in lifetime of the photosensitive drum 1 and the image flow can be caused. On the other hand, by the control in this embodiment, it becomes possible to apply the charging AC voltage providing a more proper discharge current.

The normal discharge current control increases the control time but the discharge current control is effected at the charging frequency corresponding to each of the process speeds, so that the discharge current in the operation at each of the process speeds can be obtained with high accuracy. Specifically, the normal discharge current control is characterized in that the discharge current control is carried out at the first frequency and at the second frequency. Therefore, the control circuit 13 can execute the normal discharge current control in the case where a control instruction from the user is input or in the case where information to the effect that the amount of use of the image forming apparatus 100 exceeds a predetermined amount is input from a usage detecting means. For example, the normal discharge current control may also be carried out during the post-rotation at the time when an integrated number of sheets subjected to image formation from the main switch turning on. Further, the user can instruct the execution of the normal discharge current control through an operating portion 100.

The simple discharge current control only requires, in this embodiment, the control time equal to that for the ordinary discharge current control effected at one frequency, so that the simple discharge current control may preferably be effected, e.g., during the post-rotation after every image formation on 100 sheets or during the pre-rotation after the turning-on of the main switch, at more frequent intervals than those in the normal discharge current control. Thus, it is preferable that the simple discharge current control is effected more frequently than the normal discharge current control. Specifically, the normal discharge current control is effected every 1,000 sheets and the simple discharge current control is effected every 100 sheets. As a result, even in the image forming apparatus using different frequencies correspondingly to different process speeds, it becomes possible to suppress the lowering in productivity and set an optimum charging AC voltage.

Incidentally, in this embodiment, the case where the image forming apparatus is operated at the two frequencies but in the image forming apparatus operable at two or more charging frequencies, it can be adapted only by increasing the number of the discharge current control operations effected at each of the charging frequencies in the normal discharge current control. Also in such a case, the simple discharge current control may only be required to include the discharge current control at one frequency. For example, in the image forming apparatus operable at three different charging frequencies correspondingly to three different process speeds, the discharge current control is effected at each of the three frequencies in the normal discharge current control. Then, by using the charging frequency used in the simple discharge current control as a reference charging frequency, a ratio between a control voltage value obtained at the reference charging frequency and a control voltage value obtained at another charging frequency is obtained as a correction value. Then, the discharge current control is effected at the reference frequency in the simple discharge current control and the control voltage value for other charging frequencies can be obtained from the product of the result obtained at the reference frequency and the correction value obtained above.

Further, the number of sampling points and a discharge current target value in the discharge current control vary depending on the thickness and material of the photosensitive drum 1, the material and electric resistance value of the charging roller 2, an operation environment, and the like. Therefore, the number of sampling points and the discharge current target value in the discharge current control may also be changed depending on, e.g., the environmental condition detected by the environment sensor 16.

Thus, the image forming apparatus 100 in this embodiment includes a detecting means 14 for detecting the current flowing from the charging member 2 to the photosensitive member 1 at the time when the bias is applied to the charging member 2 and includes an adjusting means for adjusting the charging bias to be applied during the image formation depending on an output of the detecting means 14. In this embodiment, the control circuit 13 functions as the adjusting means. The image forming apparatus 100 is operable in the first image forming mode in which the photosensitive member 1 rotates at a first speed and the charging bias with the first frequency is applied to the charging member 2 and is operable in the second image forming mode in which the photosensitive member 1 rotates at a second speed slower than the first speed and the charging bias with the second frequency different from the first frequency is applied to the charging member 2. Further, the image forming apparatus 100 is operable in a first test mode and a second test mode as a test mode for adjusting the charging bias to be applied during the image formation. In the first test mode (normal discharge current control), a first operation in which the photosensitive member 1 rotates at the first speed and the test bias with the first frequency is applied to the charging member 2 and a second operation in which the photosensitive member 1 rotates at the second speed and the test bias with the second frequency is applied to the charging member 2 are performed. In the second test mode (simple discharge current control), only the first operation of the first and second operations is performed. The adjusting means 13 can adjust the charging bias in each of the first and second test modes depending on an output of the detecting means 14 during the first and second operations in the first test mode. Further, the adjusting means 13 can adjust the charging bias in the first image forming mode depending on the output of the detecting means 14 during the first operation in the second test mode. Further, the adjusting means 13 can adjust the charging bias in the second image forming mode on the basis of the output of the detecting means during the first operation in the second test mode and information indicating a relationship between the outputs of the detecting means 14 during the first and second operations in the first test mode.

As described above, according to this embodiment, in the image forming apparatus using the different charging frequencies correspondingly to the different process speeds, it is possible to set a proper charging voltage while suppressing the lowering in productivity of the image. Further, in this embodiment, in the image forming apparatus operable at the plurality of process speeds in the discharge current control, it is possible to provide a proper discharge current without effecting the discharge current control at the respective process speeds.

Embodiment 2

Another embodiment of the present invention will be described. In the image forming apparatus in this embodiment, members or portions having the same or corresponding functions and constitutions as those in the image forming apparatus described in Embodiment 1 and represented by the same reference numerals or symbols, thus being omitted from detailed description. In this embodiment, the constant current control of the charging voltage is carried out by using the value of the AC current flowing at the time when the AC voltage value determined by effecting the discharge current control described in Embodiment 1 is applied.

In the case where speed-up of the image forming apparatus is advanced to permit many times of an output operation, the electric resistance value of the charging roller fluctuations in a short time. When the constant voltage control was effected in such a case, it was found that the discharge current was excessively increased. On the other hand, in the case where the constant current control is effected, even when the electric resistance fluctuation of the charging roller is caused, deviation of the discharge current is relatively small. For this reason, the constant current control is suitable for the above-described case.

In this embodiment, after effecting the discharge current control, the AC current value (control current value) when the calculated peak-to-peak voltage (Vpp) is output is obtained. Then, at the thus-obtained AC current value, the constant current control of the charging voltage during the image formation is effected.

In this embodiment, the charging roller 2 different from that in Embodiment 1 was used. The charging roller 2 used in this embodiment has the constitution simpler than that of the charging roller 2 in Embodiment 1 and thus can be expected to reduce the manufacturing cost.

Figure 11:
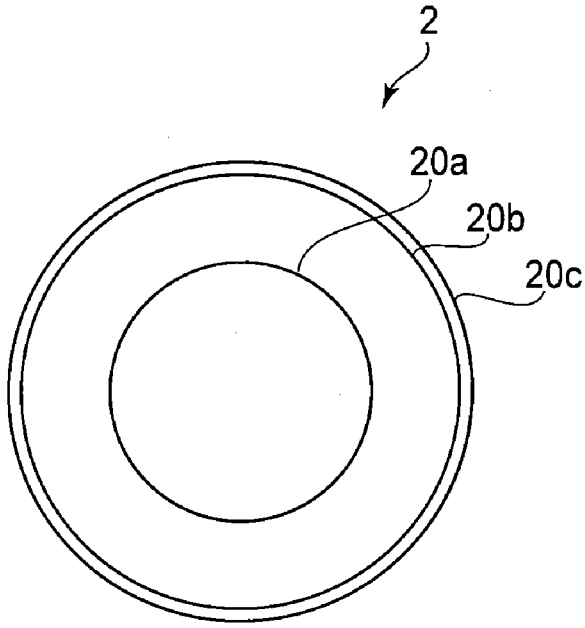
FIG. 11 is a schematic sectional view showing a layer structure of a charging roller in image forming apparatus in Embodiment 2 of the present invention.

As shown in FIG. 11, the charging roller 2 in this embodiment has a two-layer structure in which a lower layer 20*b* and a surface layer 20*c* are successively laminated in this order around a core metal (supporting member3*r*) 20*a*. The lower 20*b* is a rubber layer. The surface layer 20*a* is a protective layer for adjusting the electric resistance and preventing deposition of a contaminant.

More specifically, the charging roller 2 in this embodiment has the following specification.

Core metal 20*a*: stainless steel rod with a diameter of 6 mm

Lower layer 20*b*: epichlorohydrin rubber

Surface layer 20*a*: fluorinated coating (volume resistivity: $10^7$-$10^{10}$ ohm·cm, surface roughness (JIS ten-point average surface roughness Rz): 5 μm, layer thickness: 10 μm)

Figure 12:
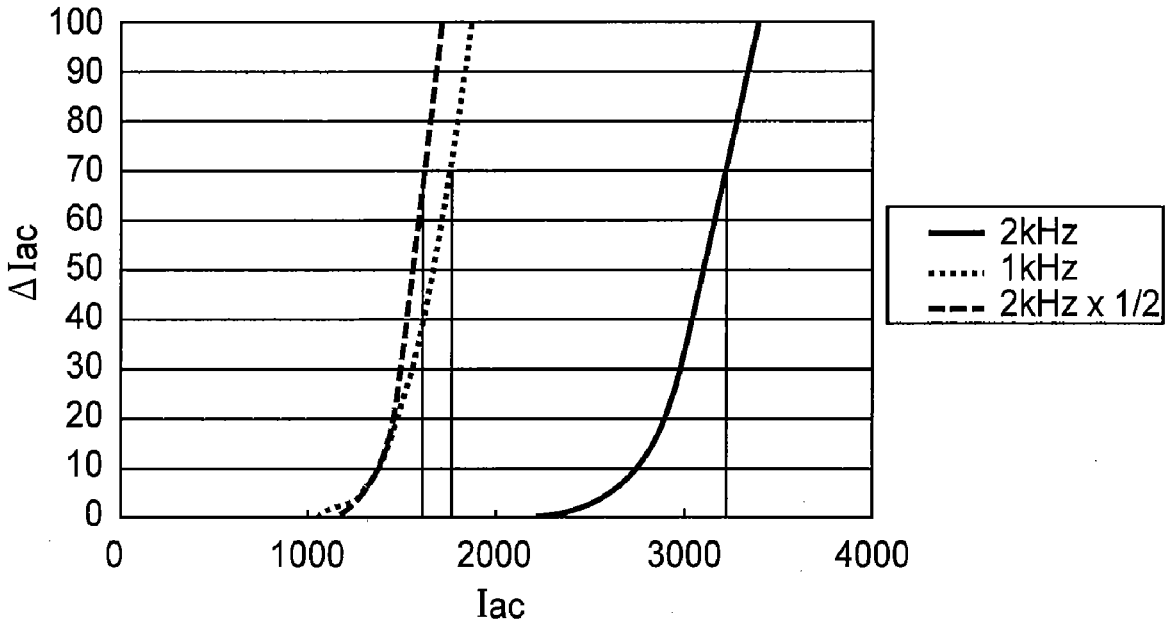
FIG. 12 is a graph showing an example of a relationship between an AC current amount and a discharge current amount.

In the case where the charging voltage is controlled with the constant current, the relationship between the current value and the discharge current is considerably different depending on the charging frequency. For example, as shown in FIG. 12, with respect to the target discharge current value 70 μA, at the charging frequency of 2 kHz and at the process speed of 300 mm/sec, the AC current value is 3200 μA. On the other hand, at the charging frequency of 1 kHz and at the process speed of 150 mm/sec, the AC current value providing the same target discharge current value (70 μA) is 1800 μA. Thus, even when both of the charging frequency and the process speed are decreased to ½ thereof, the AC current value providing the same target discharge current value is not ½ thereof.

As indicated by a curve for (2 kHz×½) in FIG. 12, when the same discharge current value (70 μA) is intended to be obtained at the ½ charging frequency (1 kHz) with the ½ AC current value (1600 μA), the discharge current value is estimated as about 40 μA from the actual curve for 1 kHz. As a result, the image defect due to the charging failure by the insufficient discharge current value is caused to occur.

Figure 13:
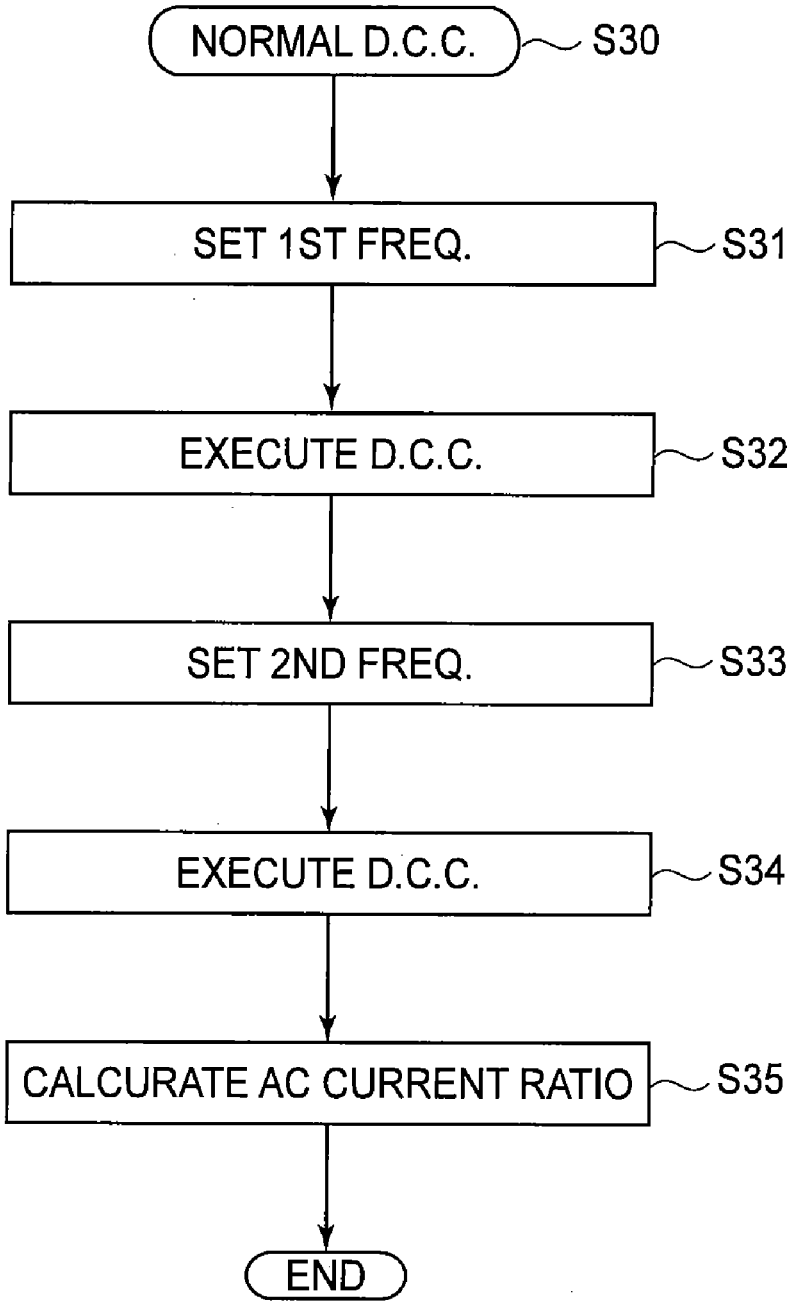
FIG. 13 is a flowchart of normal discharge current control in Embodiment 2 of the present invention.

Therefore, in this embodiment, the control described below is carried out. FIG. 13 shows a control flow of the discharge current control in this embodiment.

The control circuit 13 starts the normal discharge current control with predetermined timing (S30) and then sets the process speed at 300 mm/sec and sets the charging frequency at 2 kHz as a first frequency necessary to obtain a desired discharge current value by the normal discharge current control (S31). Then, the discharge current control is effected to obtain the AC current value (S32). Thereafter, the control circuit 13 switches the charging frequency to 1 kHz as a second frequency while keeping the process speed at 300 mm/sec (S33). Then, the discharge current control is effected to obtain the AC current value (control current value) (S34). More specifically, the AC current value in the case where the peak-to-peak voltage of the charging AC voltage obtained by the discharge current control is output is obtained in the following manner. That is, along the flow shown in FIG. 7, an applied peak-to-peak voltage (Vpp) (control voltage value) is obtained. In the case where the applied peak-to-peak voltage is, e.g., Vout shown in FIG. 6, the control current value can be obtained according to the above-described formula (2). From two results of the discharge current at the above two frequencies, the control circuit 13 as the calculating means obtains two AC current values, at the respective charging frequencies, providing the same discharge current and then calculates a ratio between the two AC current values as a correction value (S35). The calculated correction value is stored in a memory 18.

Similarly as in Embodiment 1, the simple discharge current control is effected with another timing. In this case, the process speed is set at 300 mm/sec and the discharge current control is effected at the first frequency of 2 kHz to obtain the AC current value (control current value). By calculating the product of the obtained AC current value at the charging frequency of 1 kHz and the ratio (correction value) obtained by the above-described normal discharge current control, it is possible to obtain the AC current value during the ½ speed operation.

In this embodiment, during the image formation, in place of the constant voltage control performed in Embodiment 1 so that the peak-to-peak voltage of the charging AC voltage is the control voltage value, the constant current control is carried out so that the current value is kept constant at the control current value from which the AC current value for the charging AC voltage is obtained. Similarly as in Embodiment 1, in this embodiment, as the (control peak-to-peak current value during the image forming operation at the charging frequency of 2 kHz, a result of the latest control which is either one of the normal discharge current control and the simple discharge current control is used. On the other hand, the control current value during the image forming operation at the charging frequency of 1 kHz is determined in the following manner. That is, immediately after the normal discharge current control, the control current value obtained by setting the charging frequency at 1 kHz in the normal discharge current control is used. Further, after the simple discharge current control is carried out, the control current value obtained by computation in the latest simple discharge current control is used.

As a result, even in the case where the electric resistance fluctuation of the charging roller 2 is caused and the discharge current is liable to change in the constant voltage control, it becomes possible to perform the image forming operation with proper discharge current without causing the lowering in productivity.

Embodiment 3

Another embodiment of the present invention will be described. In the image forming apparatus in this embodiment, members or portions having the same or corresponding functions and constitutions as those in the image forming apparatus described in Embodiment 1 and represented by the same reference numerals or symbols, thus being omitted from detailed description. In this embodiment, a method for reducing the time of the normal discharge current control described in Embodiments 1 and 2 will be described.

In Embodiment 1, in the normal discharge current control, first, in the setting of the process speed at 300 mm/sec and the charging frequency at 2 kHz, the sampling of 3 peak-to-peak voltages of less than Vth×2 (V) and 3 peak-to-peak voltages of not less than Vth×2 (V) was made. In addition thereto, in the setting of the process speed at 300 mm/sec and the charging frequency at 1 kHz, the sampling of 3 peak-to-peak voltages of less than Vth×2 (V) and 3 peak-to-peak voltages of not less than Vth×2 (V).

Figure 14:
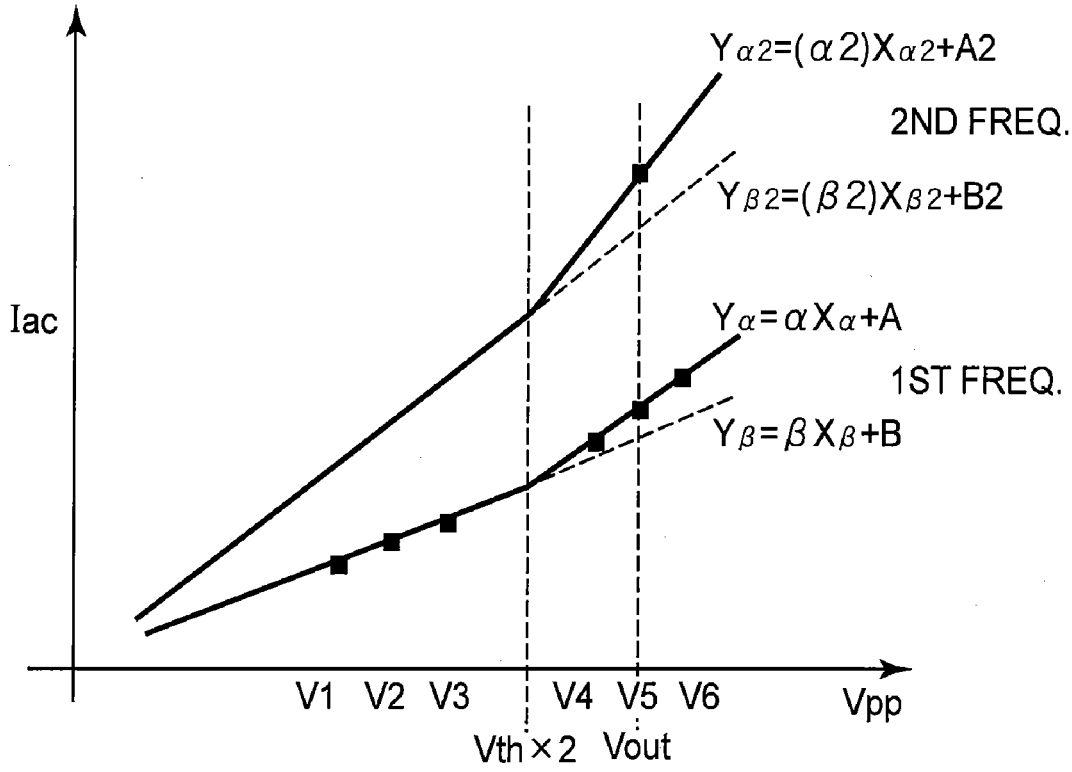
FIG. 14 is a graph showing a relationship between the peak-to-peak voltage and the AC current for illustrating the discharge current control in Embodiment 3 of the present invention.
Figure 15:
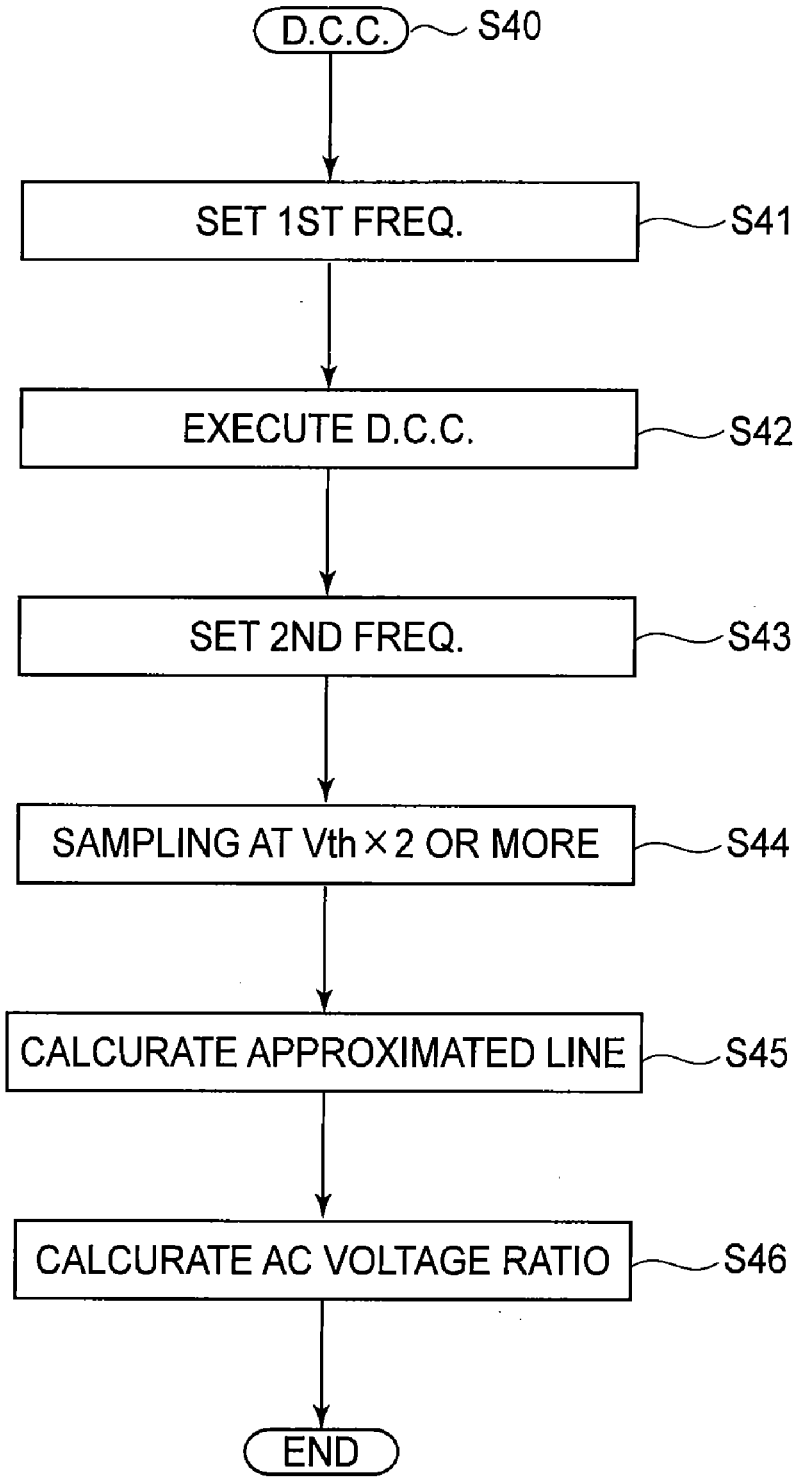
FIG. 15 is a flowchart for illustrating the discharge current control in Embodiment 3 of the present invention.

On the other hand, as shown in FIGS. 14 and 15, in this embodiment, the sampling of 3 peak-to-peak voltages of less than Vth×2 (V) and 3 peak-to-peak voltages of not less than Vth×2 (V) is made first in the setting of the process speed at 300 mm/sec and the charging frequency at 2 kHz. In addition thereto, in this embodiment, the sampling of one peak-to-peak voltage of not less than Vth×2 (V) is made in the setting of the process speed at 300 mm/sec and the charging frequency at 1 kHz (S40 to S44). The added one peak-to-peak voltage has the same AC voltage value as that of either one of the 3 peak-to-peak voltages sampled at the charging frequency of 2 kHz. In this embodiment, as the peak-to-peak voltage, V5 (Vpp) shown in FIG. 14 is used.

The discharge start voltage Vth×2 (V) does not depend on the charging frequency, so that it is possible to use the same value as that obtained when the discharge current control is effected at the first frequency. Further, the AC current characteristic obtained from the voltages V1, V2 and V3 which are less than Vth×2 (V) is substantially proportional to the frequency, so that a slope β of an approximation line obtained as a result of the discharge current control executed at the first frequency and a slope β2 of an approximation line obtained at the second frequency can be approximated as a frequency ratio. Further, the intercept B2 on the Iac axis results from a factor of approximation error of the least-square method using the three points and a factor of zero error of the high voltage measuring circuit, so that the substantially same value is reproduced in the case where the measurement is performed contemporarily by the same image forming apparatus. For that reason, the intercept B obtained in the discharge current control executed at the first frequency and the intercept B2 obtained at the second frequency can be approximated as the same value.

As a result, a linear expression, with respect to the voltages of less than Vth×2 (V) at the second frequency, represented by the following formula (5) is obtained.

$$Y\beta 2=(B2)X\beta 2+B2 \quad (5)$$

Further, from the AC current value at the discharge start point Vth×2 (V) in the linear expression (5) and the AC current value measured with the AC voltage V5 (Vpp) at the second frequency, a linear expression, with respect to the voltages of not less than Vth×2 (V) at the second frequency, represented by the following formula (6) is obtained (S45).

$$Y\alpha 2=(\alpha 2)X\alpha 2+A2 \quad (6)$$

From these equations (relationships) between the peak-to-peak voltage of the charging AC voltage and the discharge current at each of the two charging frequencies, similarly as in Embodiment 1, it is possible to obtain the AC voltage value (control voltage value) providing the same discharge current value at both of the charging frequencies. Therefore, similarly as in Embodiment 1, from the results at the above two charging frequencies, the ratio between the control voltage values can be calculated as the correction value and can be stored in the memory 18 IS46).

Incidentally, also in the case where the control current value is obtained and the charging voltage is controlled at the constant current as described in Embodiment 2, the charging current control can be effected in the normal discharge current control similarly as in this embodiment and the control current value may be obtained from the resultant AC voltage value.

Thus, in this embodiment, the number of samples peak-to-peak voltages for outputs of the AC current value measuring circuit 14 in the normal discharge current control at the second frequency is smaller than that in the normal discharge current control at the first frequency.

As a result, even in the image forming apparatus operable at the plurality of process speeds and using the charging frequencies corresponding to the process speeds, it becomes possible to effect proper charging bias control at each of the process speeds while suppressing the lowering in productivity.

Other Embodiments

As described above, the present invention is specifically described based on Embodiments 1 to 3 but is not limited thereto. For example, in the above-described embodiments, the example in which the sampling of 6 peak-to-peak voltages for obtaining the AC current values is typically made but the number of sampled peak-to-peak voltages is not limited to 6. Further, as the approximation method, the least-square method is employed but the approximation method is not limited thereto.

In the above-described embodiments, the computation and determination program for the appropriate peak-to-peak voltage value of the AC voltage value or the appropriate AC current value in the charging process of the printing step in the preparatory rotation operation period for printing corresponding to during non-image formation of the image forming apparatus was executed. However, the execution period of the program is not limited to the preparatory rotation operation period for printing but can also be during other non-image forming operations, i.e., during initial rotation operation, during sheet interval, and during post-rotation step and can also be during a plurality of non-image forming operations.

Further, in the above-described embodiments, the image forming apparatus using the cleaning (cleaner) member is used as an example but it is also possible to achieve a similar effect with respect to the charge control means in the image forming apparatus using a so-called cleaner-less system in which the cleaning member is not provided and simultaneous development and cleaning is effected by the developing device.

Further, as the photosensitive member, an amorphous silicon photosensitive member including the surface layer having a volume resistivity of about $10^{13}$ ohm·cm may also be employed. Further, the charging roller and the photosensitive drum are not necessarily required to be in contact with each other but may also be adapted to a constitution in which they are closely disposed with a gap of about several tens of microns (in a non-contact manner) so long as a dischargeable area determined by a gap voltage and a corrected Paschen curve is ensured with reliability between the photosensitive drum and the charging roller.

Further, in the above-described embodiments, the charging roller is used as a flexible contact charging member is employed but as another flexible contact charging member, it is possible to use those having a shape or material such as a fur brush, a felt, and cloth. Further, by combining various materials, those having proper elasticity, electroconductivity, surface property, and durability.

As a waveform of the AC voltage component (AC component; voltage periodically changed in voltage value) of the oscillating electric field applied to the charging roller and the developing sleeve in the above-described embodiments, it is possible to appropriately use a sinusoidal wave, a rectangular wave, a triangular wave, and the like. Further, a rectangular wave formed by turning the DC power source on and off periodically may also be used.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 065267/2009 filed Mar. 17, 2009, which is hereby incorporated by reference.

What is claimed is:

1. An image forming apparatus comprising:

a rotatable photosensitive member;

a charging member for electrically charging said photosensitive member;

an applying device configured to apply to said charging member a charging bias in the form of a DC voltage biased with an AC voltage;

a forming device configured to form a toner image on said photosensitive member;

a detecting device configured to detect a current passing between said charging member and said photosensitive member;

an image forming executing device configured to selectively execute a first image forming mode in which the charging bias in the form of the DC voltage biased with the AC voltage of a first frequency is applied to said charging member and the image is formed on said photosensitive member and a second image forming mode in which the charging bias in the form of the DC voltage biased with the AC voltage of a second frequency is applied to said charging member and the image is formed on said photosensitive member;

a test mode executing device for selectively executing a first test mode in which both of a first operation for applying to said charging member a plurality of test biases different in voltage values at a first frequency and detecting the passing current by said detecting device and a second operation for applying to said charging member a plurality of test biases different in voltage values at a second frequency and detecting the passing current by said detecting device are performed, and a second test mode in which a third operation for applying to said charging member a plurality of test biases, smaller in the number of test biases than the number of test biases in the first test mode, at the second frequency and detecting the passing current by said detecting device is performed;

a calculating device for calculating associated information from a current value detected by said detecting device in the first operation and a current value detected by said detecting device in the second operation; and a correcting device for correcting, when the image is formed in the second image forming mode, the AC voltage applied to said charging member, wherein said correcting device corrects the AC voltage applied to said charging member on the basis of the associated information calculated by said calculating device and a current value detected by said detecting device in the third operation.

2. An apparatus according to claim 1, wherein said photosensitive member is rotated at a first speed in the first image forming mode and is rotated at a second speed, slower than the first speed, in the second image forming mode, and the first frequency is higher than the second frequency.

3. An apparatus according to claim 1, wherein a frequency of execution of the second test mode by said test mode executing device is more than a frequency of execution of the first test mode by said test mode executing device.

4. An apparatus according to claim 1, wherein the AC voltage applied to said charging member in the third operation is one of values exceeding a discharge start voltage value, and wherein said correcting device corrects the AC voltage by using an approximation rectilinear line obtained from a detection result thereof.

5. An apparatus according to claim 1, wherein said photosensitive member is rotated at the first speed in the first operation, the second operation and the third operation.

* * * * *